US009840894B2

(12) United States Patent
Jenne et al.

(10) Patent No.: US 9,840,894 B2
(45) Date of Patent: Dec. 12, 2017

(54) DRILL HEAD AND DEVICE WITH A SLIDING CONTACT ELECTRICAL CONNECTION FOR DRILLING A BORE IN THE GROUND

(71) Applicant: TERRA AG, Reiden (CH)

(72) Inventors: Dietmar Jenne, Brittnau (CH); Alexander Stauffer, Walliswil (CH)

(73) Assignee: TERRA AG FÜR TIEFBAUTECHNIK, Reiden (CH)

( * ) Notice: Subject to any disclaimer, the term of this patent is extended or adjusted under 35 U.S.C. 154(b) by 408 days.

(21) Appl. No.: 14/661,630

(22) Filed: Mar. 18, 2015

(65) Prior Publication Data

US 2015/0275626 A1 Oct. 1, 2015

(30) Foreign Application Priority Data

Apr. 1, 2014 (DE) ..... 10 2014 104 552

(51) Int. Cl.

| | |
|---|---|
| ***E21B 41/00*** | (2006.01) |
| ***E21B 7/06*** | (2006.01) |
| ***E21B 17/02*** | (2006.01) |
| ***E21B 47/09*** | (2012.01) |
| ***E21B 7/04*** | (2006.01) |

(52) U.S. Cl.

CPC ..... *E21B 41/0085* (2013.01); *E21B 7/046* (2013.01); *E21B 7/062* (2013.01); *E21B 17/028* (2013.01); *E21B 47/09* (2013.01)

(58) Field of Classification Search

None

See application file for complete search history.

(56) References Cited

U.S. PATENT DOCUMENTS

| | | | | |
|---|---|---|---|---|
| 4,544,215 | A * | 10/1985 | Fritsch | H01R 39/38 310/239 |
| 8,157,002 | B2 | 4/2012 | Clarkson et al. | |
| 9,284,793 | B2 * | 3/2016 | D'Silva | H01R 39/385 |
| 2005/0230098 | A1 * | 10/2005 | Sand | E21B 7/068 166/65.1 |
| 2011/0017473 | A1 * | 1/2011 | Clarkson | E21B 17/028 166/380 |

FOREIGN PATENT DOCUMENTS

| | | | |
|---|---|---|---|
| DE | 10005475 | A1 | 8/2001 |
| DE | 112010003039 | T5 | 6/2012 |
| EP | 1124037 | A1 | 8/2001 |

OTHER PUBLICATIONS

European Search Report for corresponding European application 15 160434 dated Oct. 27, 2015.

* cited by examiner

*Primary Examiner* — Shane Bomar

(74) *Attorney, Agent, or Firm* — McCormick, Paulding & Huber LLP

(57) ABSTRACT

The invention relates to a drill head and a device for drilling a bore in the ground, the drill head having a first unit coupleable with an inner drill pipe of a double drill pipe assembly and a second unit coupleable with the outer drill pipe of the double drill pipe assembly. By means of the inner drill pipe the first unit is rotatable about an axis of rotation relative to the second unit which is drivable by means of the outer drill pipe. The drill head has a sliding contact arrangement for establishing an electrical connection between the first unit and the second unit.

14 Claims, 11 Drawing Sheets

DRILL HEAD AND DEVICE WITH A SLIDING CONTACT ELECTRICAL CONNECTION FOR DRILLING A BORE IN THE GROUND

CROSS REFERENCE TO RELATED APPLICATIONS

This application claims the priority of German patent application no. 10 2014 104 552.1, which was filed on Apr. 1, 2014, and of which the entire disclosure is incorporated by reference herein.

BACKGROUND OF THE INVENTION

The invention relates to a drill head for drilling a bore in the ground, as usable, for example, in the so-called HDD (horizontal direction drilling) methods. The drill head has a first unit coupleable with an inner drill pipe of the double drill pipe assembly and a second unit coupleable with an outer drill pipe of the double drill pipe assembly. By means of the inner drill pipe the first unit is rotatable about an axis of rotation relative to the second unit which is drivable by means of the outer drill pipe. Further, the invention relates to a device for drilling a bore in the ground by means of such a drill head.

By means of drill heads so-called pilot bores between a starting point and a target point can be made, which can then be enlarged by means of a second drill head and/or a back reamer. Dependent on the nature of the ground through which the bore is to be drilled, different drill heads are used, such as so-called rock reamers which, for example, comprise a roller bit arrangement or so-called impact moles or down-the-hole hammers by means of which a hammer drilling operation is performed. Both the pilot bores as well as the reaming of a bore by means of a reaming tool can take place in a liquid-supported manner, in particular supported by a bentonite rinsing liquid. By means of the rinsing liquid the excavated earth is removed from the bore channel. Pilot bores and reaming bores can be made, for example, by means of a horizontal drilling device sold by the applicant under the name "TERRA-JET". By means of this drilling device horizontal direction-controlled drillings are possible. For this, the drill head, by means of which the pilot bore is made, usually has a battery-powered trackable transmitter so that its position can exactly be determined from the earth's surface by means of a portable locating device. For this, however, the locating device has to be directly vertically above the sonde. Further, the drilling depth must not be too deep so that the signal emitted by the sonde reaches the earth's surface. Based on the determined position of the sonde, the drill head can be controlled such that a desired path of the drilling to be made is achieved. The first unit driven by the inner drill pipe can have means for the excavation of the earth. For example, rock drill heads are known which are provided with three roller bits that are each equipped with hard metal pins. Such rock drill heads are rotated at 30 to 300 rpm. In doing so, the roller bits roll upon the earth, in particular upon the rocks. The surface pressure between the hard metal pins of the roller bit and the rock causes that rock pieces, so-called cuttings, are broken away and then removed backward out of the bore channel by means of the rinsing liquid. At the same time, the bentonite rinsing liquid stabilizes the bore channel.

When using a pneumatic down-the-hole hammer as a drill head, compressed air flows through the inner bore of the inner drill pipe into the down-the-hole hammer and drives the hammer ram of the down-the-hole hammer with up to 2500 impacts per minute. The hammer ram hammers directly onto the rock drill head, the hard metal pins of which excavate the rock by means of the impacts. The exhaust air of the down-the-hole hammer blows the excavated earth or rock particles (cuttings) backward through the bore channel.

For performing a controlled drilling by means of these drill heads, such as a controlled horizontal drilling, the center axis of the drill head is curved or bent. The bend or the curvature is usually in the range between 1° and 3°. When the drill head is driven by means of the inner drill pipe and when the casing of the drill head is simultaneously pressed into the ground without rotation, the drill head moves along a curved bore along its bend. For drilling in a straight line, the casing of the drill head has to be slowly rotated continuously. Usually, the casing of the drill head is rotated at 10 to 30 rpm to obtain a straight bore. In the case of down-the-hole hammers, the controlled bore can, alternatively to the provision of the curvature or a bend in the center axis of the down-the-hole hammer, also be made by means of a design of the excavation area of the drill head, preferably equipped with hard metal pins, which is asymmetrical with respect to the center axis. Here, the excavation area is provided at the front end of the drill head and is in direct contact with the earth to be excavated. By way of the asymmetrical design of the excavation area, the drill head would produce a non-linear bore without a rotation of the down-the-hole hammer by means of the outer drill pipe. To produce a linear bore by means of the down-the-hole hammer, this hammer has to be slowly rotated continuously by means of the outer drill pipe, preferably at 30 to 50 rpm.

For locating the rock drill head in the ground, the electronic sonde already mentioned is inserted into a sonde chamber in the outer casing of the drill head which is rotatable by means of the outer drill pipe. The sonde comprises a battery or an accumulator for its energy supply. Preferably, the sonde is protected against shocks and impacts by damping elements. The sonde chamber formed by an opening is covered with a cover plate in which a relatively large slot is formed through which the sonde signal can reach the outside. Alternatively, the cover plate may also be made of a material, such as plastic, which does not shield the sonde signal. Further, a slot provided in a metal cover plate can be filled or covered by plastic.

For locating the sonde, usually an employee walks vertically above the drill head with a locating device and locates the drill head. If, however, the locating depth becomes too deep or if strong disturbing signals are present in the ground, a locating from above is no longer possible. Likewise, the battery life may be too short for the duration of the drilling so that it is not possible to locate a battery-powered sonde from above. When making a bore under water or a busy road, the drill head likewise cannot be located in the described way.

From the document DE 100 05 475 A1, a drilling device having an inner drill pipe and an outer drill pipe is known. For both drill pipes, one common rotating device is provided which drives the drill pipes synchronously. The drill pipes are driven via separate driving gears, each of which being a component part of a transmission. One of the transmissions can be displaced in feed direction in order to displace the inner drill pipe relative to the outer drill pipe.

From the document DE 11 2010 003 039 T5, a vertical drilling device having a borehole tool is known, which borehole tool comprises a slip ring arrangement that is inserted radially between a shaft and a casing. The slip ring arrangement is configured to provide various electrical communication channels between the shaft and the casing.

SUMMARY OF THE INVENTION

It is the object of the invention to specify a drill head and a device for drilling a bore in the ground, in which information on the position and/or orientation of the drill head can even be determined when a locating of a sonde arranged in the drill head is not readily possible from above.

This object is solved by a drill head for drilling a bore in the ground having the features of claim 1 as well as by a device for drilling a bore in the ground by means of such a drill head. Advantageous developments of the invention are specified in the dependent claims.

By means of a drill head for drilling a bore in the ground having the features of claim 1 it is possible to provide a sonde or a sensor unit for determining the position of the drill head via a cable running in the inner drill pipe with energy, data and/or signals and/or to transmit data and/or signals from the sensor unit and/or sonde arranged in the outer casing through a cable running through the inner drill pipe to the earth's surface. As a result, the sensor unit and/or the sonde can directly be connected to a control and/or energy supply unit of the drive unit for driving the double drill pipe assembly. As a result, the boring time is not limited by the battery capacity for supplying a trackable sonde that is arranged in the drill head. Further, the sonde signal can easily be transmitted to the earth's surface via a cable so that no employee who tracks the movement of the drill head by means of a locating device has to be positioned vertically above the drill head with the locating device either.

By way of the sliding contact arrangement, a cable which serves to transmit energy, data and/or signals can be passed through the inner drill pipe, and the energy, data and/or signals can be transmitted via the sliding contact arrangement to the outer drill pipe. Here, the sonde and/or the sensor unit are preferably arranged in the outer casing of the drill head driven by the outer drill pipe, in particular in a sonde chamber provided in the outer casing. Alternatively, the cable can also run through the outer drill pipe and the energy, data and/or signals transmitted via the cable can be transmitted via the sliding contact arrangement to a unit of the drill head which is coupled with the inner drill pipe and in which then the sensor and/or the sonde are preferably arranged.

The sliding contact arrangement preferably has a one-piece base body with at least one slip ring. In contrast to slip rings having a base body assembled from several segments, this has the advantage that the base body with the slip ring is both easier to produce and mechanically more robust and less susceptible to failure.

Further, it is advantageous when the sliding contact arrangement, in addition to the one-piece base body with the slip ring, comprises a contact brush and that the base body with the slip ring can jointly be removed from the drill head and inserted into the drill head together with the contact brush as a structural unit.

Preferably, the first unit is an assembly of the drill head which is drivable about the axis of rotation by means of the inner drill pipe. The second unit is preferably an assembly of the drill head which is drivable about the axis of rotation by means of the outer drill pipe. The axis of rotation is preferably the longitudinal axis and/or the center axis of the drill head. The first unit is preferably connectable to the inner drill pipe in a rotationally fixed manner at least in one direction of rotation. The second unit is preferably connectable to the outer drill pipe in a rotationally fixed manner at least in one direction of rotation. The direction of rotation and/or the speed of rotation of the inner drill pipe and of the outer drill pipe can be different from each other, wherein a drive unit for driving the double drill pipe assembly which is arranged at the earth's surface has a first drill pipe receptacle for receiving one end of the inner drill pipe and a second receptacle unit for receiving the end of the outer drill pipe, both receptacle units being drivable at different speeds of rotation and/or in different directions of rotation.

In an advantageous development, the sliding contact arrangement is connected to the first and/or second unit releasably and re-connectably. Such a releasable and re-connectable connection can, for example, be established via a clamping connection, a snap-in connection and/or a screw connection. As a result, the sliding contact arrangement can easily be removed from the drill head when it is not required for a drilling operation, and can again be integrated into the drill head when an energy, data and/or signal transmission between the first unit and the second unit is required. Thus, the sliding contact arrangement can in particular be removed from the drill head whenever a battery-powered sonde which is located by means of a known locating device is inserted into the drill head. In the case of drilling operations in which a cable-bound energy supply and/or data and/or signal transmission is useful and/or necessary, then the sliding contact arrangement is again integrated into the drill head. As a result, an easy resource-conserving use of the drill head depending on the demand is possible.

Further, it is advantageous when the sliding contact arrangement comprises at least a first contact element which is preferably designed as a slip ring and connected to the first unit in a rotationally fixed manner and when the sliding contact arrangement comprises a second contact element which is preferably designed as a brush and connected to the second unit in a rotationally fixed manner. Here, the first contact element and the second contact element form a sliding contact. It is particularly advantageous when the first contact element is connected to the first unit releasably and re-connectably and when the second contact element is connected to the second unit releasably and re-connectably. It is also advantageous to provide several sliding contacts, wherein the first contact elements of these sliding contacts are formed by several slip rings arranged on a base body and the second contact elements are formed by several brushes arranged next to each other. The brushes are in particular electrically conductive contacts pressed against a slip ring by means of a spring force. As a result, a simple and compact design of the sliding contact arrangement is possible.

Further, it is advantageous when the second unit has a cover which is preferably sealed and through which at least one component of the sliding contact arrangement is insertable into the drill head and removable therefrom when the cover is open. In particular, a base body with at least one slip ring is removable from the drill head and again insertable therein when the cover is open. As a result, a particularly easy handling of the drill head and of the sliding contact arrangement is possible. On the one hand, in this way an easy maintenance of the sliding contact arrangement is possible and, on the other hand, an easy removal of the sliding contact arrangement is possible so that the drill head can also be operated without the sliding contact arrangement without a great assembly effort being required for this.

Further, it is advantageous when the second unit comprises an outer casing of the drill head and when the first unit comprises an inner drill pipe adapter with which the inner drill pipe is connectable. A first contact element of the sliding contact arrangement is connected to the second unit in a rotationally fixed manner. At least a second contact element of the sliding contact arrangement is connected to the inner drill pipe adapter, preferably in a rotationally fixed manner, releasably and re-connectably. As a result, an easy integration of the sliding contact arrangement into the drill head is possible.

It is particularly advantageous when the sliding contact arrangement comprises at least two sliding contacts for establishing an electrical connection between the first unit and the second unit and when the two sliding contacts each have a first contact element and a second contact element, when the two first contact elements form a first contact arrangement and the two second contact elements form a second contact arrangement, and when the first contact arrangement is connected to the first unit releasably and re-connectably and/or the second contact arrangement is connected to the second unit releasably and re-connectably. As a result, energy, data and/or signals can be easily transmitted via a two-wire line from the control unit to the sensor unit and/or sonde in the drill head. The transmission of electrical energy, signals and/or data via at least two electrical contacts offers, compared to the use of only one sliding contact, the advantage of a safe transmission as otherwise the inner or outer drill pipe would have to be used additionally as an electrical conductor.

It is particularly advantageous when an electrical device is arranged in a sealed closable opening of the second unit and when the electrical device is electrically connected to the second contact element or the second contact arrangement via a cable. By way of this opening, in particular a sonde chamber or sensor chamber is formed. Preferably, this chamber is additionally sealed toward the sliding contact arrangement. Here, the cable can be sealed by means of known cable glands. The opening is preferably closable by means of a cover which, in the case of a sonde, is made of a material that is non-shielding or only slightly shielding or has a slot that is closed with such a material. As a result, it is guaranteed that the sonde signal from the drill head can reach the outside so that it can be located by means of corresponding locating devices at the earth's surface.

Here, it is advantageous when the electrical device comprises a transmitter for locating by means of a locating device arranged at the earth's surface, a sensor for determining the position of the drill head, a sensor for determining the inclination and/or a sensor for determining the rotary position of the drill head. In this way, information required or helpful for drilling can be determined, by means of which information the drilling along a desired path is possible.

Further, it is advantageous when the drill head comprises at least one seal and when the first unit comprises an inner drill pipe adapter, wherein the seal keeps away dirt present at the drill pipe-side end of the inner drill pipe adapter and/or liquid present at the drill pipe-side end of the inner drill pipe adapter from the sliding contact arrangement. As a result, a safe protection of the sliding contact arrangement is possible so that the function of the sliding contact arrangement is not affected by dirt and/or humidity.

Further, it is advantageous when a first end of a cable is electrically connected to at least one first contact element of the sliding contact arrangement and when the cable is passed through a section of the first unit. In this way, a cable passed from the earth's surface through the drill pipe to the drill head can easily be passed up to the sliding contact arrangement so that a safe energy, signal and/or data transmission via the sliding contact arrangement is possible. Preferably, the cable is passed along the axis of rotation of the first unit, preferably inside the inner drill pipe adapter.

Further, the first contact element and/or the first contact arrangement can be electrically connectable to a cable passed through the inner drill pipe.

The first unit preferably comprises a roller bit arrangement coupleable with the inner drill pipe and/or a down-the-hole hammer coupleable with the inner drill pipe and the outer drill pipe. The air for driving the down-the-hole hammer is preferably lead through the pipe sections of the inner drill pipe from the earth's surface to the down-the-hole hammer. As a result, by means of the drill head earth, in particular rock, can be excavated so that a drilling, in particular a horizontal drilling, is easily possible.

Further, it is advantageous when a drilling liquid exiting the double drill pipe assembly at the drill head-side end thereof is directed through the drill head to the front end opposite to the drill pipe-side end of the drill head and exits the drill head thereat. As a result, excavated earth can be transported and removed by means of the rinsing liquid through the already made borehole. Thus, this drilling fluid also serves as a rinsing fluid. In addition, by using a suitable drilling liquid, a stabilization of the bore channel can be established. Preferably, a bentonite drilling fluid is used.

Further features and advantages of the invention result from the following description which explains the invention on the basis of embodiments in connection with the enclosed Figures.

DESCRIPTION OF THE PREFERRED EMBODIMENTS

Figure 1:
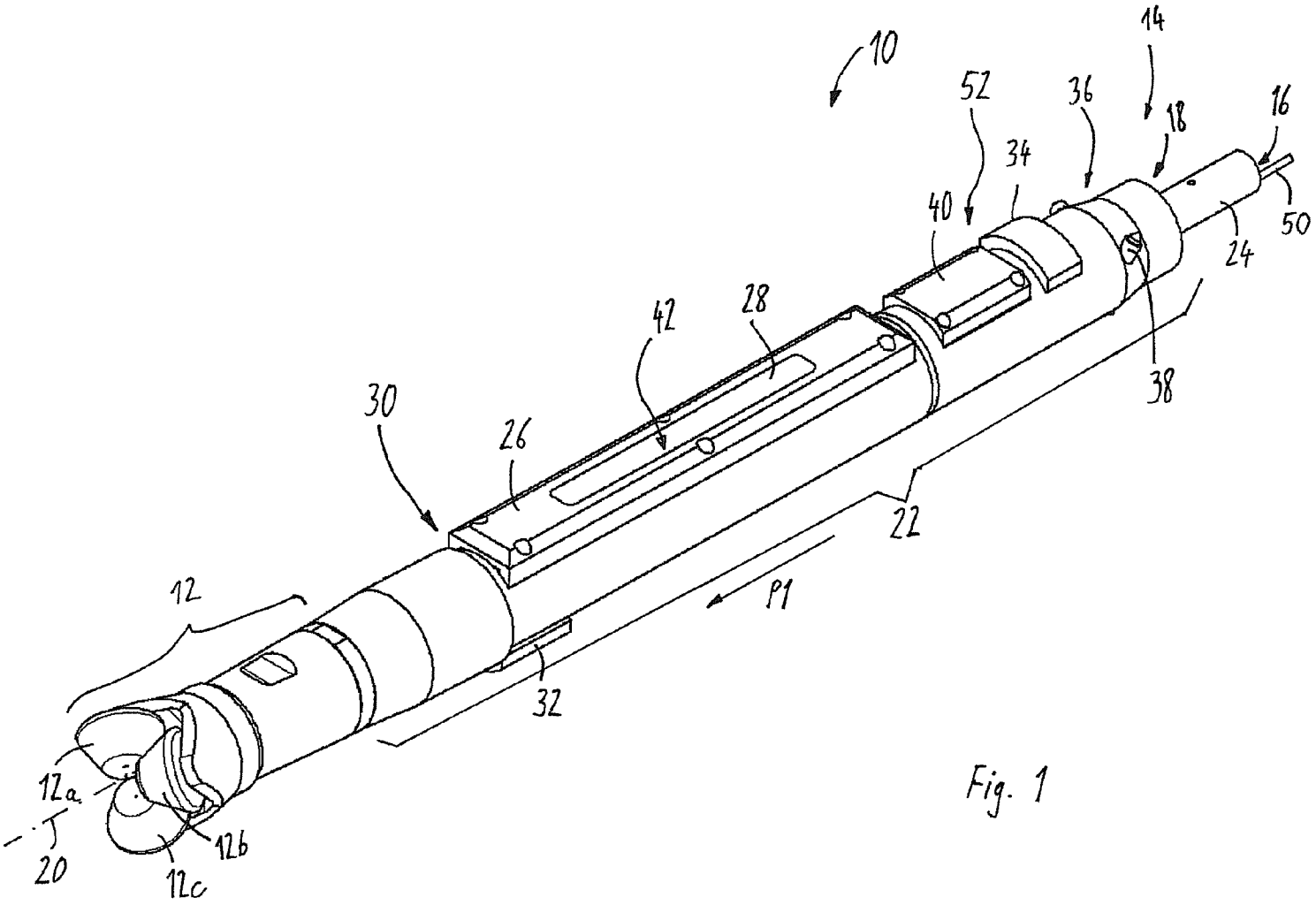
FIG. 1 shows a perspective side view of a drill head according to a first embodiment.

FIG. 1 shows a perspective side view of a rock drill head 10 according to a first embodiment. At its front end, the rock drill head 10 has a roller bit arrangement 12, which is also referred to as tricone, and at its rear end 14 a first interface 16 for connecting the rock drill head 10 to the inner drill pipe of a double drill pipe assembly and a second interface 18 for connecting the rock drill head 10 to the outer drill pipe of the double drill pipe assembly. The first interface 16 and the second interface 18 each have a conical internal thread into which a respective conical external thread present at the end of the inner drill pipe and at the end of the outer drill pipe can be screwed. In other embodiments, the interfaces 16, 18 and the external threads of the inner drill pipe and of the outer drill pipe can have non-conical, i.e. cylindrical threads or other connecting elements.

The roller bit arrangement 12 comprises three roller bits 12*a* to 12*c* which upon a rotation of the inner drill pipe, which is connected to the rock drill head 10, about an axis of rotation 20 rolls upon the earth present in front of the rock drill head 10 in feed direction P1 and, in doing so, removes earth particles, so-called cuttings, from the earth. The earth can in particular be rock material, the roller bits then removing rock particles upon a rotation about the axis of rotation 20. The rock drill head 10 can be used in a direction-controlled drilling device, in particular in a horizontal drilling system which is also referred to as horizontal direction drilling device. Here, a drive unit drives the inner drill pipe and the outer drill pipe of the double drill pipe assembly with different drive heads. The inner drill pipe as well as the outer drill pipe can each be assembled from several drill pipe sections, common drill pipe sections having a length in the range between 3 and 4.5 m. The drill pipe sections of the inner drill pipe are usually screwed to each other. The drill pipe sections of the outer drill pipe, too, are screwed to each other so that both the drill pipe sections of the inner drill pipe and the drill pipe sections of the outer drill pipe are connected to each other in a rotationally fixed manner at least in one direction of rotation. The inner drill pipe drives the roller bit arrangement 12 at a speed of rotation in the range of usually 30 to 300 rpm. Through the inside of the inner drill pipe a bentonite drilling fluid is pumped which exits at the front end from the rock drill head 10 in the area of the roller bit arrangement 12 and transports the earth particles excavated by the roller bit arrangement 12 through the bore channel backward out of the bore channel. At the same time, the bentonite drilling fluid stabilizes the bore channel. The rock drill head 10 has an outer casing 22 and an inner drill pipe adapter 24, at the drill pipe-side end of which the first interface 16 is provided. The inner drill pipe adapter 24 is connected to the roller bit arrangement 12 in a rotationally fixed manner via an inner tube not visible in FIG. 1 so that the inner drill pipe adaptor 24 and the inner tube transmit the rotary motion of the inner drill pipe to the roller bit arrangement 12. In other embodiments, the rock drill head 10 can also have a gearing stage with a gear increase or a gear reduction so that the speed of rotation of the inner drill pipe and the speed of rotation of the roller bit arrangement 12 can be different.

The outer casing 22 has a cover which is formed as a flange plate 26 and covers a sonde chamber 42 provided in the outer casing 22 in a water-proof manner. The flange plate 26 has a window 28 made of a material that is permeable to the sonde signal so that a sonde signal can pass through the window 28. As a result, it is possible to locate the sonde signal generated by the sonde by means of a known locating device from the earth's surface. The outer casing 22 is bent by 2° at a bend 30 so that the angle of the center axis of the portion of the outer casing 22 before the bend 30 spans an angle of 178° with respect to the center axis of the portion of the outer casing 22 after the bend 30. In other embodiments, the bend 30 can also have an angle in the range between 1 and 10°, in particular 2° to 5°. As an alternative to the bend 30, the outer casing 22 may also have a corresponding curvature by means of which the roller bit arrangement 12 has the same relative position to the first and the second interface 16, 18 of the rock drill head 10.

By means of the bend 30 or by means of a corresponding curvature of the outer casing 22 of the rock drill head 10 a controlled drilling is possible. Dependent on the angular position of the outer casing 22, the front part of the rock drill head 10 is inclined with respect to the rear part of the rock drill head 10 by 2° downward, by 2° to the right, by 2° to the left or by 2° upward or in a corresponding intermediate position between these positions so that the drill head 10 produces a bore with a correspondingly curved path without a rotation of the outer casing 22. To produce a straight bore, the outer casing 22 of the rock drill head 10 has to be rotated continuously with a rotation in the range of 30 to 60 rpm. For this, the outer casing 22 is connected at the rear end 14 via the second interface 18 to the outer drill pipe of the double drill pipe assembly. The second interface 18 preferably has an internal thread into which an external thread of the outer drill pipe is screwed. As a result, the outer drill pipe can rotate the outer casing 22 of the rock drill head 10 at least in one direction of rotation. If the bore produced by means of the rock drill head 10 shall have a curved path, then the rotation of the outer casing 22 is stopped dependent on the desired direction of the curve in an angular position required for this and only the inner drill pipe is driven for an advance of the rock drill head 10. In addition, the rock drill head 10 is pressed further into the earth via the drill pipe by means of a drive unit. If the rock drill head 10 produces a curvature, i.e. if the rock drill head 10 moves along a curve, then it is supported with a front support plate 32 and its rear support plate 34 at the bore channel. The hard metal pins 38 arranged at a rear conical section 36 of the outer casing 22 serve to pull out the rock drill head 10 backward from the bore channel in a rotating manner, if necessary.

Next to the sonde chamber 42 closable by the flange plate 26, the rock drill head 10 has a slip ring chamber 52 closable in a water-proof manner by means of a flange plate 40, in which slip ring chamber a sliding contact arrangement can be arranged if necessary, as will still be explained in more detail further below.

Figure 2:
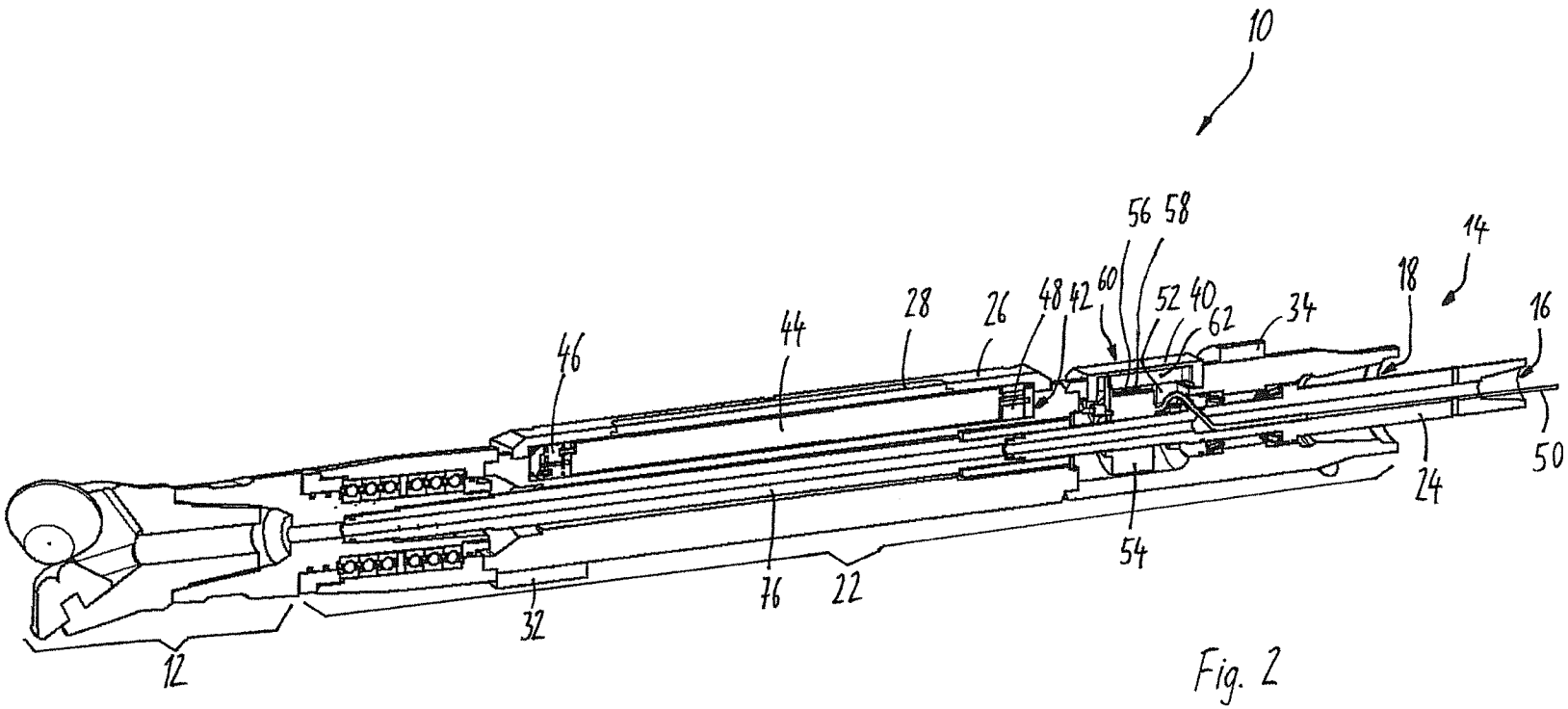
FIG. 2 shows a sectional view of the drill head according to FIG. 1.

FIG. 2 shows a sectional view of the rock drill head 10 according to FIG. 1. In this illustration, the sonde chamber 42 covered by means of the flange plate 26 is well visible. In the sonde chamber 42, a sensor unit 44 is arranged. Between the front end of the sensor unit 44, as viewed in feed direction P1, and the outer casing 22, a first damping element 46 is provided and between the rear end of the sensor unit 44, as viewed in feed direction P1, and the outer casing 22 a second damping element 48 is provided in the sonde chamber 42. The damping elements 46, 48 protect the electronic sensor unit 44 against shocks and impacts, which in particular occur as a result of the drilling operation. The sensor unit 44 is inserted laterally into the sonde chamber 42 when the flange plate 26 is open. By way of the slot 28 provided in the flange plate 26, a position signal emitted by the sensor unit 44 can reach the outside, preferably the earth's surface above the rock drill head 10. The energy required for this as well as required data and/or signals can be transmitted via a cable 50 from the earth's surface through the double drill pipe assembly up to the rock drill head 10. The cable 50 runs in the inner drill pipe of the double drill pipe assembly up to the drill head 10. The sonde chamber 42 is, however, located in the outer casing 22 of the rock drill head 10. In the present embodiment, the drill head 10 has two circumferential slip rings 56, 58 formed on a base body 54 connected to an inner drill pipe adapter 24 in a rotationally fixed manner as well as in the outer casing 22 brush arrangements which are complementary to the slip rings 56, 58, a further cable for connecting the brush arrangement and the sensor unit 44 being provided. In other embodiments, the sliding contact arrangement 60 consisting of the slip rings 56, 58 and the complementary brush arrangements can also comprise only one slip ring and one complementary brush arrangement or more than two slip rings and two complementary brush arrangements, in particular four slip rings and four complementary brush arrangements. In the case of four slip rings and four complementary brush arrangements, two slip rings and two complementary brush arrangements can be used for transmitting the energy required for the voltage supply of the sensor unit 44, and two lines for the data and/or signal transmission between a control unit arranged at the earth's surface and the sensor unit 44. If the sensor unit 44 is, however, only used for emitting position signals which can be located from the earth's surface, the energy supply of the sonde can be accomplished via the cable 50 and the sliding contact arrangement 60. Thus, it is not necessary to also arrange batteries or accumulators in the rock drill head 10 so that in particular the sonde chamber 42 can be designed correspondingly smaller.

Additionally or alternatively, the sensor unit 44 can determine the position of the rock drill head 10 and transmit the determined position as a signal or as data via the sliding contact arrangement 60 and the cable 50 to a control unit at the earth's surface. Additionally or alternatively, the sensor unit 44 can determine the inclination of the rock drill head 10 and/or the angular position of the outer casing 22 of the rock drill head 10 and transmit these via the sliding contact arrangement 60 and the cable 50 to the control unit at the earth's surface.

As an alternative to the sensor unit 44, a battery-powered trackable sonde can be inserted into the sonde chamber 42 if in an intended drilling operation the drill head is trackable conventionally with a locating device from the earth's surface. In this case, when the inner drill pipe adapter 24 is disassembled, the base body with the slip rings 56, 58 can be removed from the slip ring chamber 52 when the flange plate 40 is open. Alternatively or additionally, also the brush arrangement is removed from the rock drill head 10. In this way, the rock drill head 10 can be used like a conventional rock drill head without sliding contact arrangement 60 and can be re-inserted into the rock drill head 10 in the case of drillings which require an energy, data and/or signal transmission to and/or from the sensor unit 44 via the cable 50. As a result, wear of the sliding contact arrangement 60 is prevented whenever it is not required for drilling. The cable 50, too, can completely be removed from the inner drill pipe adapter 24 so that the cable 50 is neither damaged nor is the assembly of the inner drill pipe with the inner drill pipe adapter 24 impeded. The cable feed-through for the cable 50 into the slip ring chamber 52 is sealed by means of a suitable cable gland. When removing the cable 50, the cable feed-through is sealed by a corresponding dummy plug or a corresponding closing plug so that the slip ring chamber 52 is also sealed without a cable 50 and in particular no drilling fluid can enter the slip ring chamber 52.

Sensor units 44 which are connected to a control unit at the earth's surface via a cable 50 are also referred to as cable sondes. A cable sonde thus enables extreme drillings with great locating depths and under surfaces which do not allow that locating devices are carried along the earth's surface vertically above the drill head 10. For example, in the case of drillings under rivers or lakes, locating devices cannot readily be carried along at the earth's surface. Likewise, drillings in depths are possible in which a transmission from battery-powered sondes to locating devices at the earth's surface are not possible. Both by means of a higher transmission power due to a voltage supply via the cable 50 and by the active determination of the position of the rock drill head 10 by means of the sensor unit 44 and by transmitting position information via the cable 50 to the earth's surface drillings at great depths are possible. Here, the invention is based on the realization that it is more favorable to pass the cable 50 inside the inner drill pipe instead of between the inner drill pipe and the outer drill pipe since thereat it could easily be damaged due to different speeds of rotation and/or directions of rotation. Instead, the cable 50 is passed inside the inner drill pipe up into the drill head 10, wherein the energy, data and/or signals are transmitted by the cable 50 via a sliding contact arrangement 60 to the outer casing 22 of the rock drill head 10 in which the sensor unit 44 is arranged.

Figure 3:
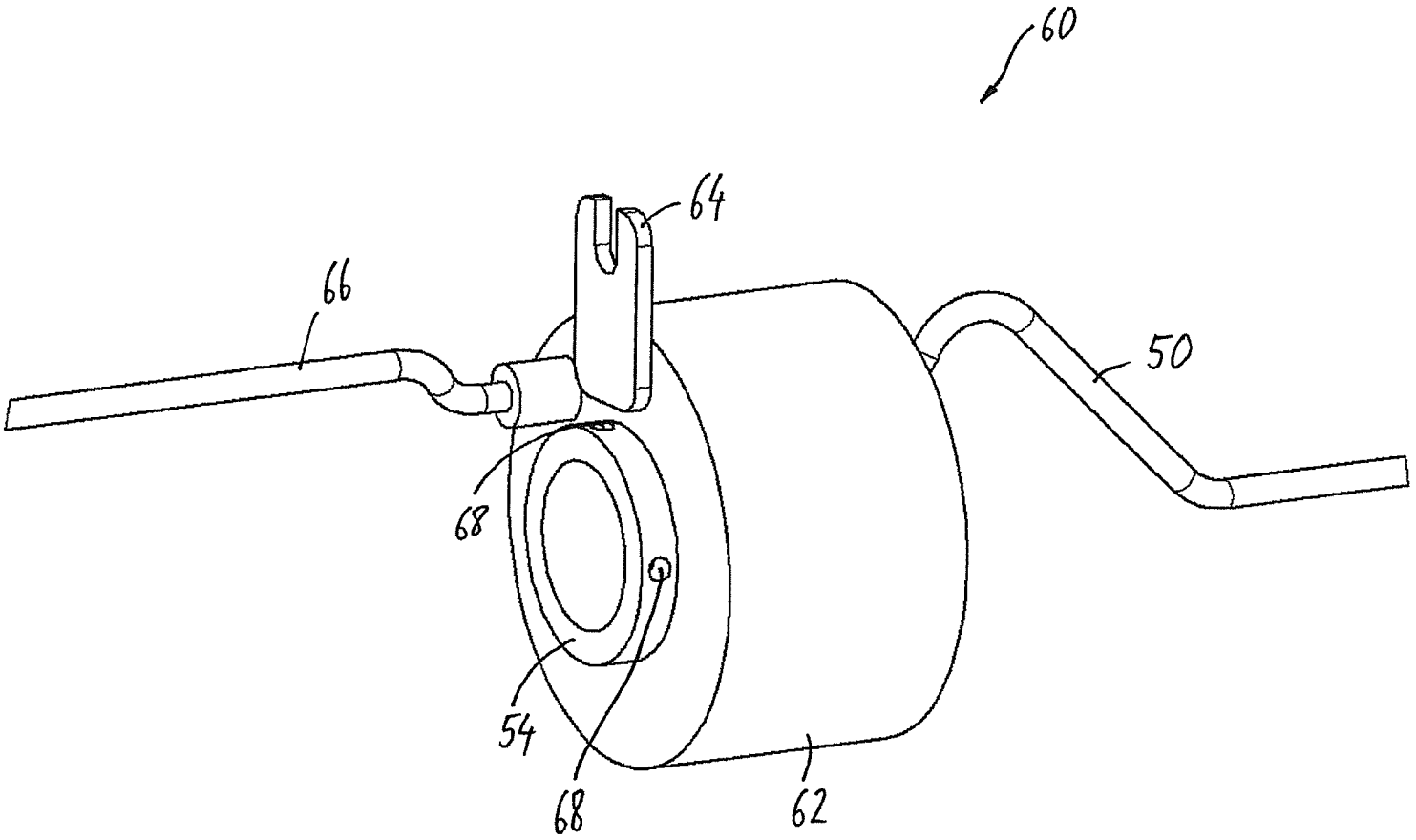
FIG. 3 shows a perspective side view of a sliding contact arrangement according to a first embodiment.
Figure 4:
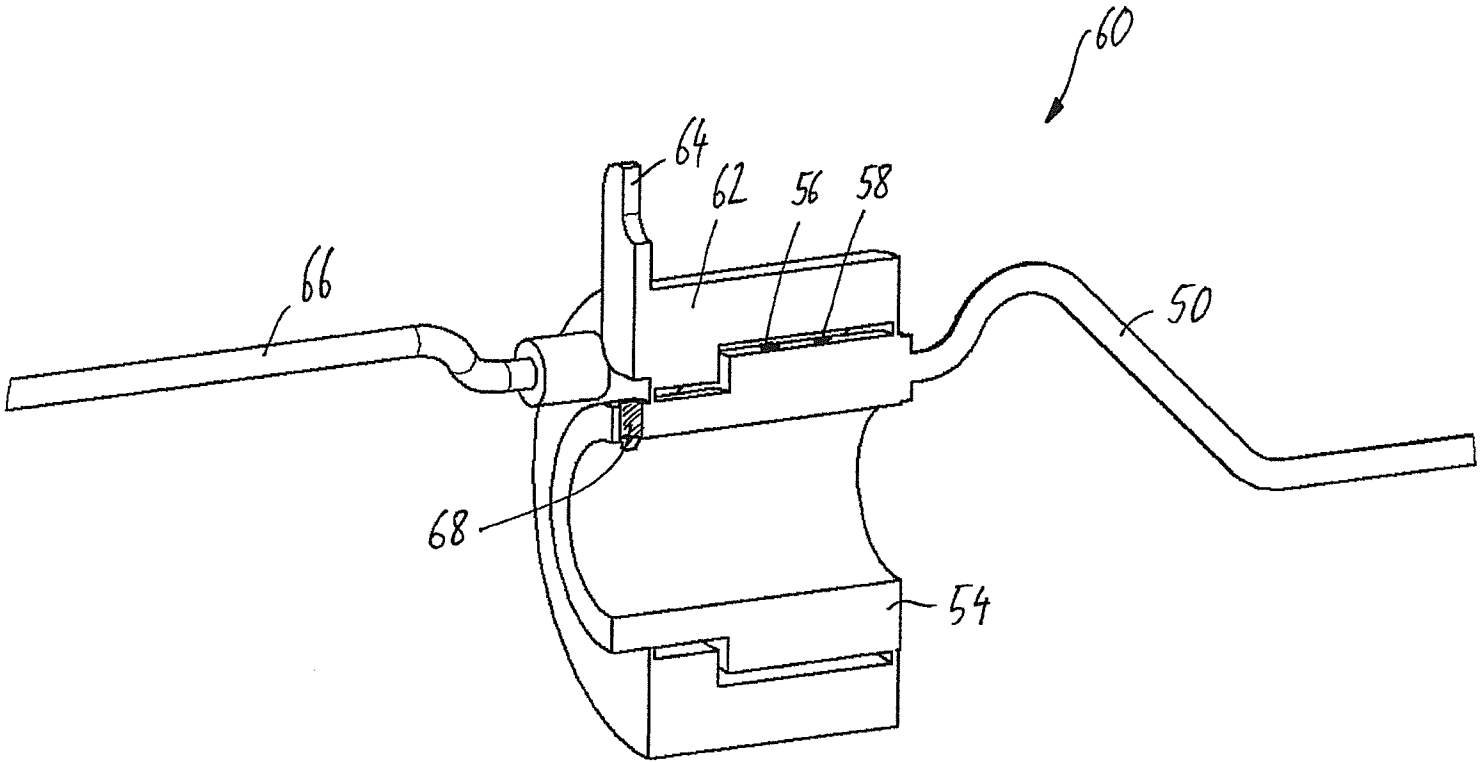
FIG. 4 shows a sectional view of the sliding contact arrangement according to FIG. 3.

In FIG. 3, the sliding contact arrangement 60 is illustrated in the removed state, wherein both the base body 54 and the brush arrangement 62 are illustrated. FIG. 4 shows a cross-section through the sliding contact arrangement 60. The brush arrangement 62 is connected via a lug 64 and a screw that can be passed through an opening of the lug 64 to the outer casing 22 of the rock drill head 10. Via the lug 64, the brush arrangement 62 is fixed to the sonde chamber 52 and thus to the outer casing 22 in a rotationally fixed manner. Further, the brush arrangement 62 is connected to the sensor unit 44 via a cable 66. The base body 54 with the slip rings 56, 58 is secured on the external hexagon of the inner drill pipe adapter 24 by means of several threaded pins 68. The sliding contact arrangement 60, as already explained, serves to electrically transmit energy, data and/or signals from the outer casing 22 to the inner drill pipe. In the same manner as the cable 50, the cable 66 is sealed in a water-proof manner by means of a cable gland in a sealing area 70 illustrated in FIG. 5. The fitting and the removal of the sliding contact arrangement 60 into and from the rock drill head 10 is accomplished by means of the removal of the flange plate 40 and the disconnection of the threaded pins 68. Further, the inner drill pipe adapter 24 is disconnected and pulled backward out of the drill head 10. Further, the cable glands provided for sealing are disconnected from the cables 50, 66. Subsequently, the sliding contact arrangement 60 with the cables 66, 50 can be removed from the slip ring chamber 52. The cable 50 is composed of several cable sections which preferably correspond to the length of the drill pipe sections of the double drill pipe assembly. The cable ends of the cable sections are electrically connected in a suitable manner and are both electrically isolated and sealed against the drilling fluid additionally transported through the inner drill pipe. After disconnection of the cable 66 from the sensor unit 44, the sliding contact arrangement 60 together with the cable sections 50, 66 can completely be removed from the slip ring chamber 52 and the drill head 10. As already explained, the drill head 10 can then be used with conventional battery-powered sonde arrangements.

Figure 5:
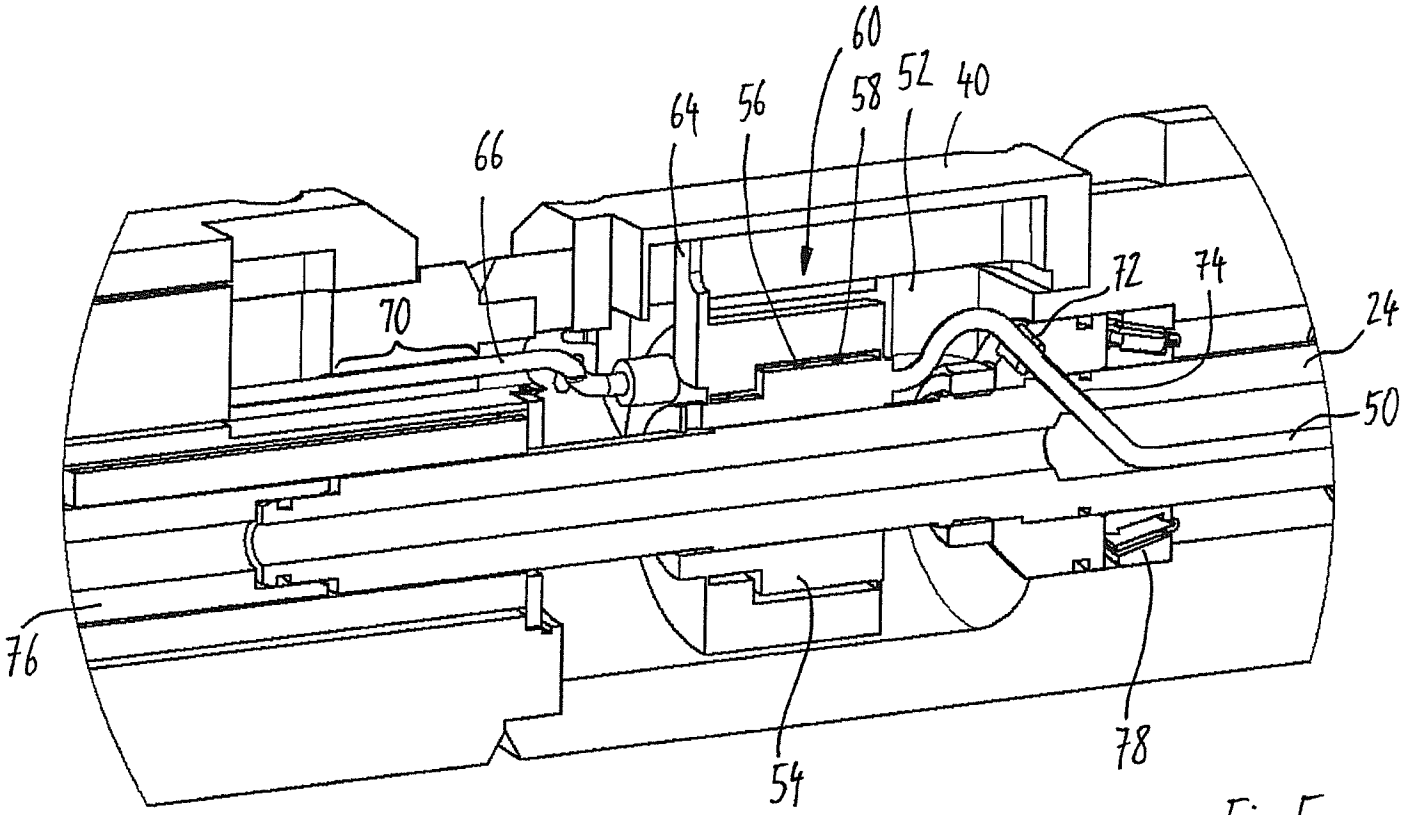
FIG. 5 shows a perspective sectional view of a detail of the drill head according to FIGS. 1 and 2 with the sliding contact arrangement according to FIGS. 3 and 4 inserted into the drill head.

FIG. 5 is a sectional view of a detail of the rock drill head 10. The sealing of the cable 50 passed through the inner drill pipe adapter 24 against the slip ring chamber 52 is provided in the areas 72 and 74.

Figure 6:
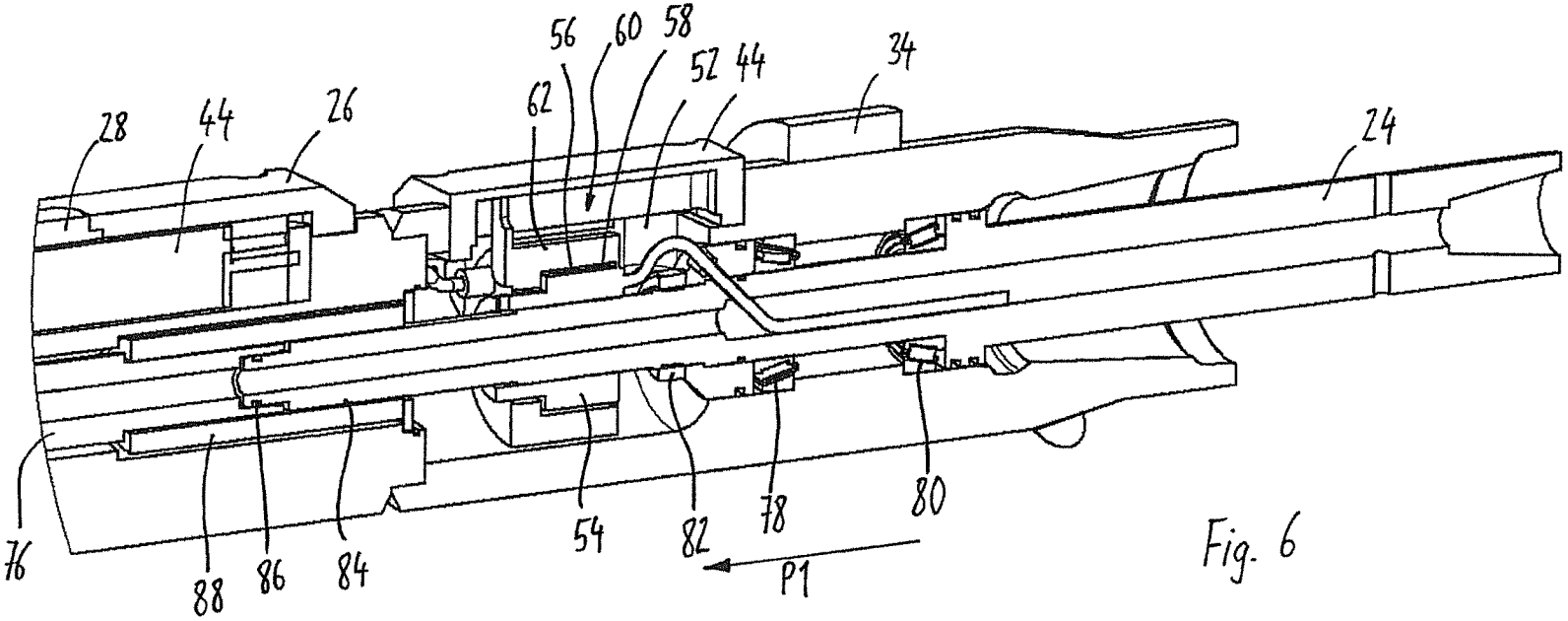
FIG. 6 shows a perspective sectional view of the rear end of the drill head according to FIGS. 1 and 2.
Figure 7:
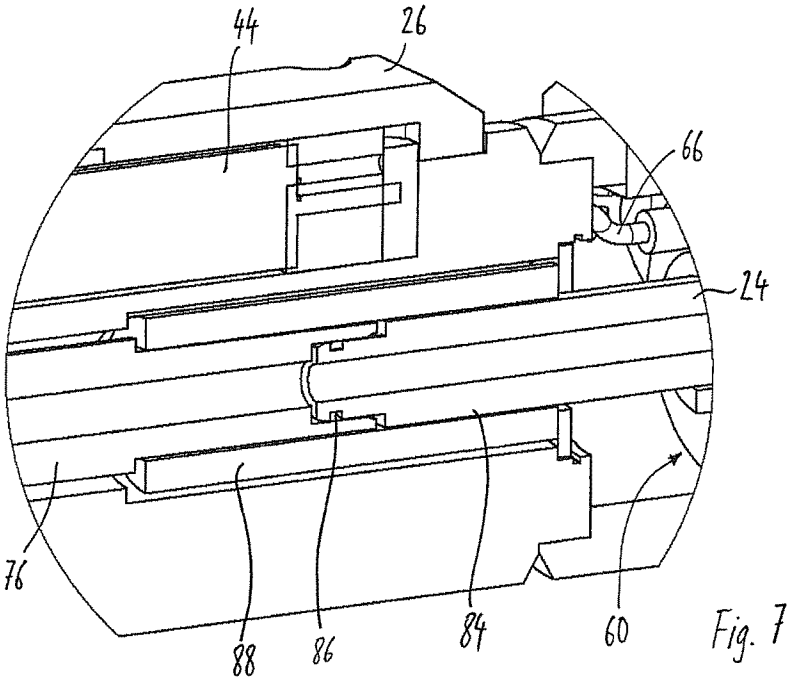
FIG. 7 shows a sectional view of a detail of the drill head according to FIGS. 1 and 2.

FIG. 6 shows a detail of a rear end of the rock drill head 10, and the detailed view illustrated in FIG. 7 shows a plug connection between the inner drill pipe adapter 24 and an inner tube 76 of the drill head 10 that transmits the rotary movement of the inner drill pipe adapter 24 to the roller bit arrangement 12. The inner drill pipe adapter 24 is mounted in the outer casing 22 via two bearings 78, 80. Typically, these bearings are tapered roller bearings. Both bearings absorb radial forces, the bearing 80 additionally absorbs thrust forces in feed direction P1, the bearing 78 additionally absorbs tension forces opposite to the feed direction P1. Via a nut 82 which is accessible via the slip ring chamber 52 and is screwed onto an external thread of the inner drill pipe adapter 24, the inner drill pipe adapter 24 is kept in this position. For disconnecting the base body 54 of the sliding contact arrangement 60 from the inner drill pipe adapter 24, an open-end wrench has to be inserted into the slip ring chamber 52 after removal of the flange plate 40, by means of which the nut is kept in its position. Subsequently, the inner drill pipe adapter 24 is rotated so that the inner drill pipe adapter 24 is rotated out of the nut and is disconnected therefrom. Thereafter, the inner drill pipe adapter 24 can be pulled backward out of the drill head 10. Near its front end, the inner drill pipe adapter 24 has an external hexagon 84 and a circumferential groove 86 into which a non-illustrated seal, preferably an O-ring, is inserted. The external hexagon 84 has a large lateral play with respect to an internal hexagon socket 88 connected to the inner tube 76, which socket in turn has a relatively large play with respect to an external hexagon of the inner tube 76. This connection enables a transmission of the torque while at the same time providing alignment compensation.

FIG. 7 shows a detail of the elements for alignment compensation illustrated in FIG. 6 at the interface between the inner drill pipe adapter 24 and the inner tube 76. As can be seen thereat, the front end of the inner drill pipe adapter 24 has a circumferential groove 86 into which a non-illustrated seal, preferably an O-ring, is inserted for sealing between the inner drill pipe adapter 24 and the inner tube 76. The drilling fluid is led from the inner drill pipe through the inner drill pipe adapter 24 into the inside of the inner tube 76 and through this tube to the roller bit arrangement 12.

Figure 8:
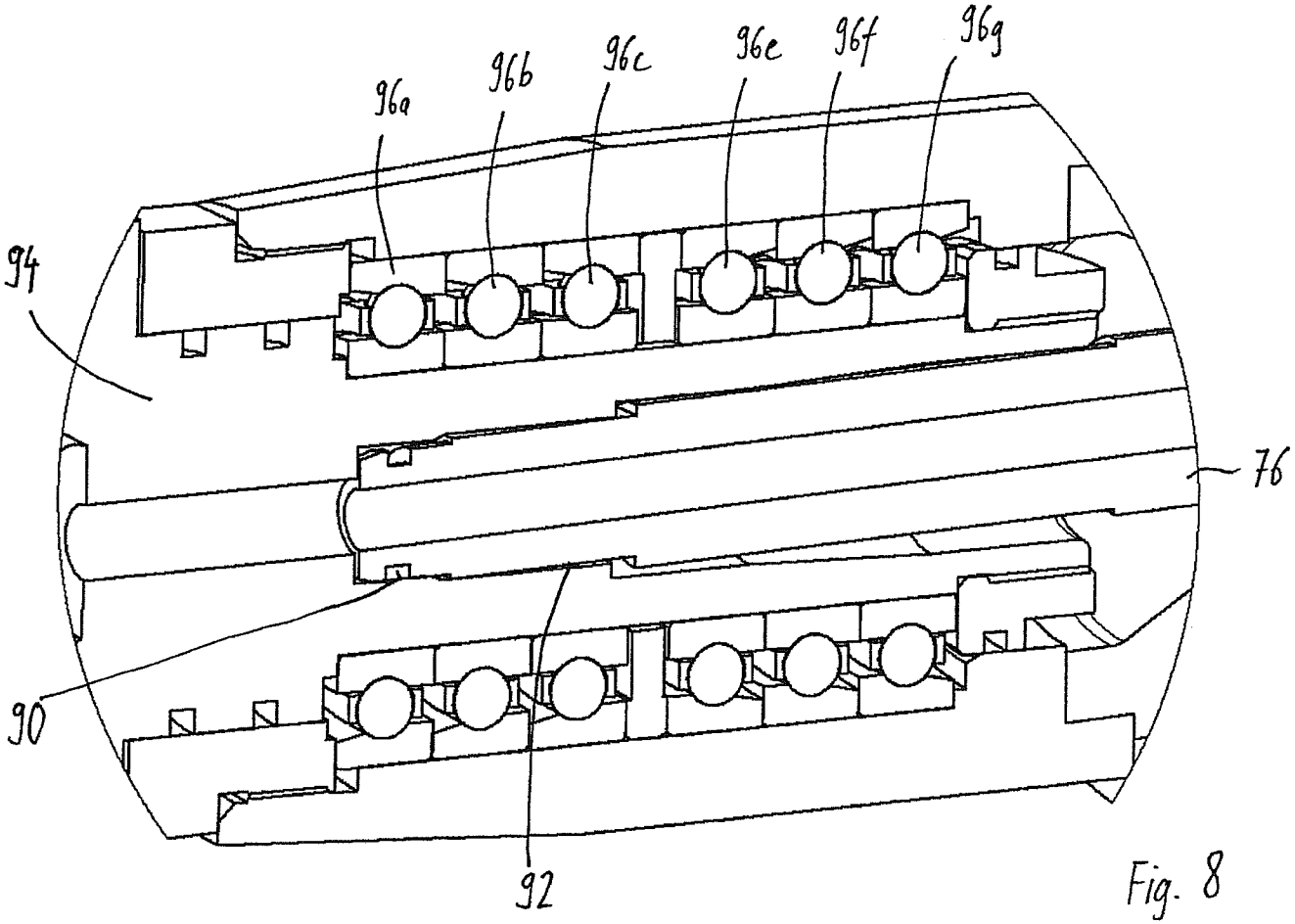
FIG. 8 shows a sectional view of a further detail of the drill head according to FIGS. 1 and 2.

FIG. 8 shows a sectional view of a detail of the drill head 10 at the junction between the inner tube 76 and the so-called roller bit receptacle 94. This connection is established with alignment compensation. At the front end, the inner tube 76 has an external hexagon 92 which projects with a lateral play into a complementary internal hexagon section of the roller bit receptacle 94. At the front end before the internal hexagon, the inner tube 76 has a circumferential groove 90 into which for sealing between the inner tube 76 and the roller bit receptacle 94 a seal, preferably an O-ring, is inserted. Further, several bearings 96*a* to 96*f* arranged one after the other in feed direction P1 are arranged which, in the present embodiment, are designed as ball bearings. In other embodiments, also other suitable bearings can be provided. The bearings 96*a* to 96*f* guide and hold the roller bit receptacle 94.

Figure 9:
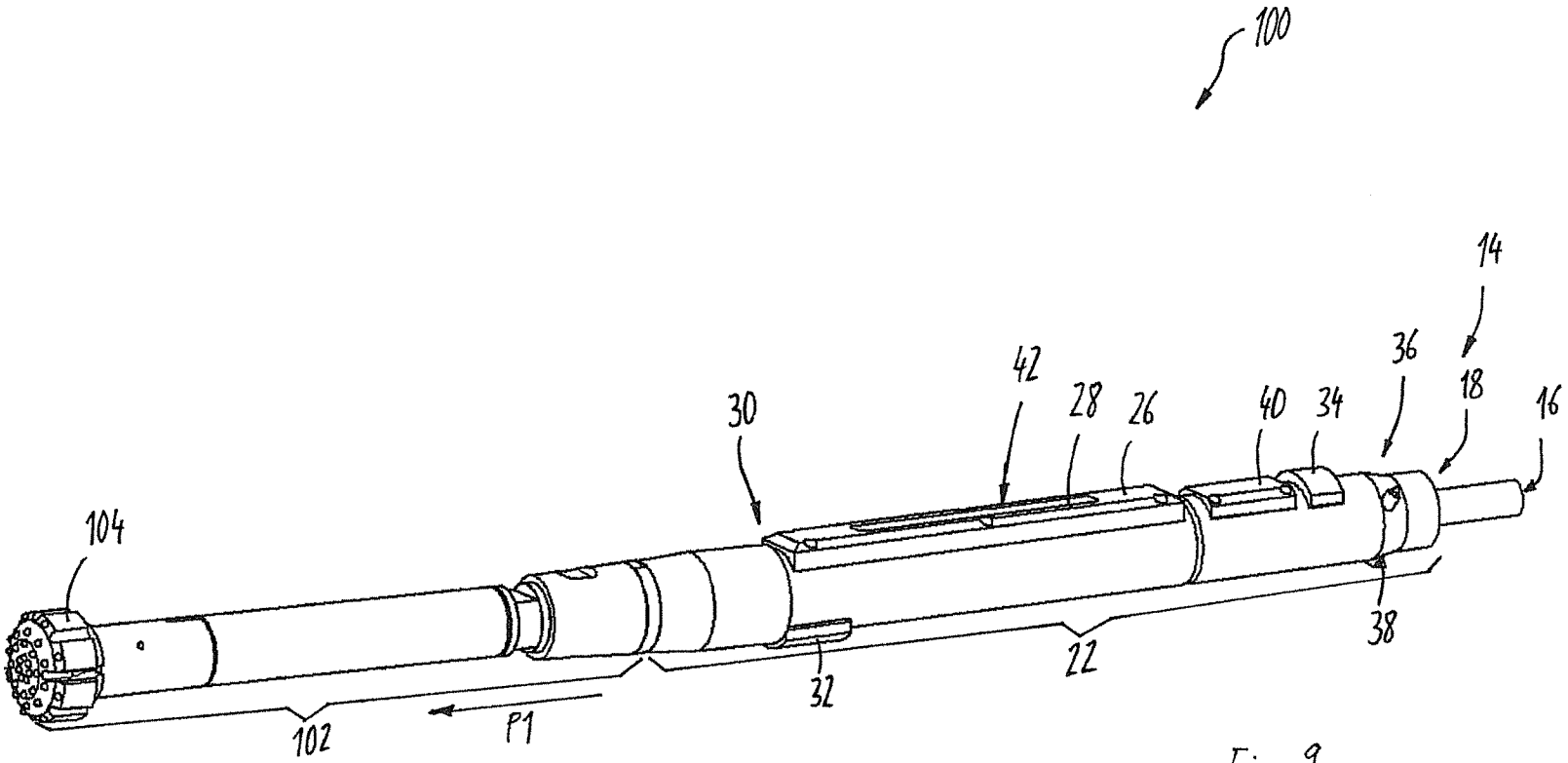
FIG. 9 shows a perspective side view of a drill head according to a second embodiment.
Figure 10:
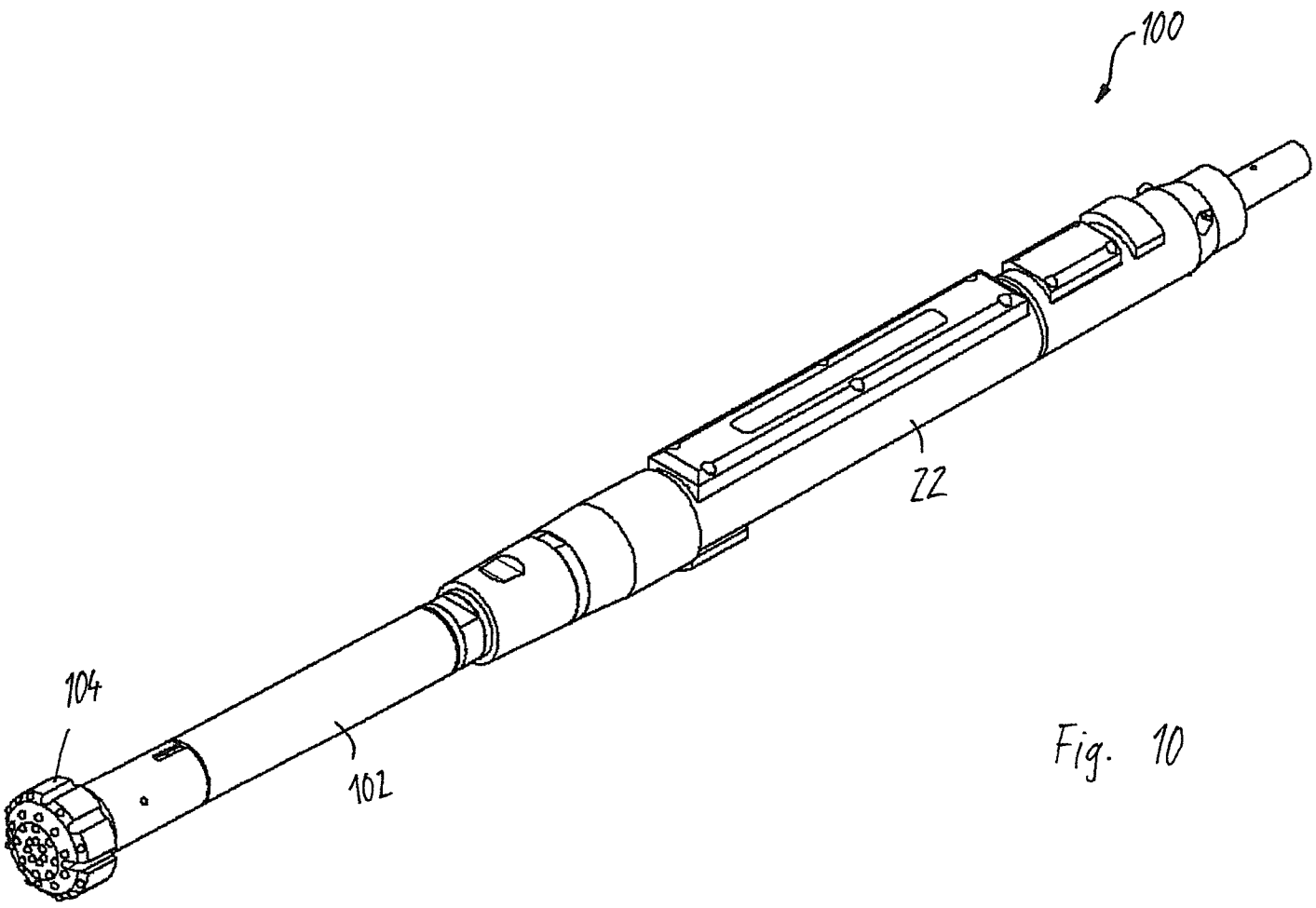
FIG. 10 shows a further perspective side view of the drill head according to FIG. 9.

In FIG. 9 and FIG. 10, a perspective side view of a drill head 100 according to a second embodiment is shown. The drill head 100 differs from the rock drill head 10 according to FIGS. 1 to 8 only in that instead of the roller bit arrangement 12 a down-the-hole hammer 102 is provided. This down-the-hole hammer 102 is driven by means of compressed air which is led through the inner drill pipe and by means of which the hammer ram of the down-the-hole hammer 102 is driven with up to 2,500 strikes per minute. The hammer ram of the down-the-hole hammer 102 directly strikes the drilling tool 104, the hard metal pins of which excavate the earth, in particular rock material. The exhaust air of the down-the-hole hammer 102 blows the excavated earth particles backward through the bore channel. Here, the inner drill pipe may not be driven or, alternatively, be rotated in the same manner as indicated for the rock drill head 10. The controlled drilling by means of the drill head 100 is performed in the same manner as described in connection with the drill head 10 as due to the bend 30 the drill head 100 a bent bore is produced and only by way of a rotation of the outer casing 22 a straight bore is made possible.

Figure 11:
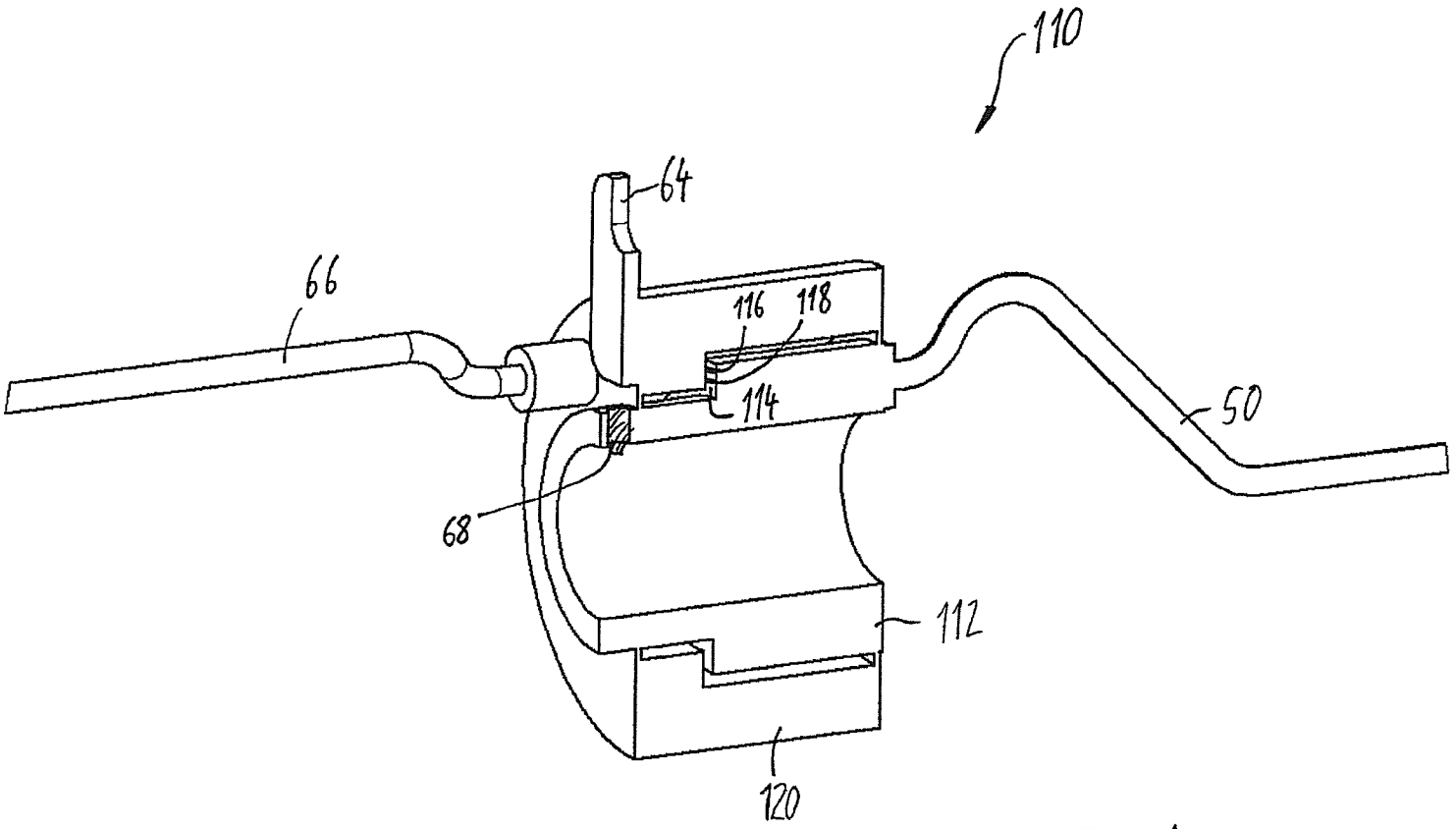
FIG. 11 shows a sectional view of a sliding contact arrangement according to a second embodiment.

In FIG. 11, a sectional view of a sliding contact arrangement 110 according to a second embodiment is shown. At the base body 112 of the sliding contact arrangement 110 the slip rings are not provided at the circumference of the base body 112 but at a face-side section 114. In the present embodiment, two slip ring contacts 116, 118 are provided at the end face section 114, wherein in a stator 120 of the sliding contact arrangement 110 complementary brush arrangements for establishing an electrical contact between the slip ring contacts 116, 118 and the stator 120 are provided. The sliding contact arrangement 110 can be inserted into the drill heads 10, 100 as an alternative to the sliding contact arrangement 60.

The sliding contact arrangements 60, 110 preferably have a base body 54, 112 with at least one slip ring 56, 68, 116, 118. The base body 54, 112 with the slip ring 56, 68, 116, 118 forms a structural unit together with at least one complementary brush arrangement 62, which structural unit can preferably jointly be removed from the drill head and inserted therein.

As an alternative to the sliding contact arrangements 60, 110 arrangeable in the drill head 10, 100, the sliding contact arrangement can also be designed as an adapter which is arranged between a conventional drill head and the double drill pipe assembly.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A drill head for drilling a bore in the ground, comprising a first unit coupleable with an inner drill pipe of a double drill pipe assembly;

a second unit coupleable with an outer drill pipe of the double drill pipe assembly, wherein (by means of the inner drill pipe) the first unit is rotatable about an axis of rotation relative to the second unit which is drivable by means of the outer drill pipe; and a sliding contact arrangement for establishing an electrical connection between the first unit and the second unit, wherein the sliding contact arrangement is releasably and re-connectably connected to at least one of the first unit and the second unit;

wherein the sliding contact arrangement comprises at least two sliding contacts for establishing an electrical connection between the first unit and the second unit;

wherein the two sliding contacts each comprise a first contact element and a second contact element;

wherein the two first contact elements form a first contact arrangement and wherein the two second contact elements form a second contact arrangement; and wherein the first contact arrangement is releasably connected to the first unit and/or the second contact arrangement is releasably connected to the second unit.

2. The drill head according to claim 1, wherein the sliding contact arrangement comprises at least a first contact element connected to the first unit in a rotationally fixed manner; and a second contact element connected to the second unit in a rotationally fixed manner; and wherein the first contact element and the second contact element form a sliding contact.

3. The drill head according to claim 2, wherein one of the first and second contact elements is designed as at least one slip ring formed on a one-piece base body and the respective other of the first and second contact elements is designed as a brush arrangement which is complementary to the slip ring, wherein the base body with the slip ring together with the brush arrangement forms a structural unit which is releasably and re-connectably connected to at least one of the first and the second unit.

4. The drill head according to claim 1, wherein the second unit has a sealed cover through which at least one component of the sliding contact arrangement is insertable into the drill head and removable therefrom when the cover is open.

5. The drill head according to claim 1, wherein the second unit comprises an outer casing of the drill head; and the first unit comprises an inner drill pipe adapter with which the inner drill pipe is connectable, wherein at least a first contact element of the sliding contact arrangement is connected to the inner drill pipe adapter in a rotationally fixed manner and wherein at least a second contact element of the sliding contact arrangement is connected to the second unit in a rotationally fixed manner.

6. The drill head according to claim 1, wherein an electrical device is arranged in a sealed closable opening of the second unit and one of the electrical device is electrically connected to the second contact element and the second contact arrangement via a cable.

7. The drill head according to claim 6, wherein the electrical device comprises a transmitter for locating by means of a locating device arranged at the earth's surface, a sensor for determining the position of the drill head, a sensor for determining the inclination and/or a sensor for determining the rotary position of the drill head.

8. The drill head according to claim 1, wherein via the sliding contact arrangement an electrical device arranged in the second unit is supplied with energy, data and/or signals that are transmitted to the electrical device and/or data and/or signals are transmittable from the electrical device.

9. The drill head according to claim 1, wherein the drill head comprises at least one seal, and the first unit comprises an inner drill pipe adapter, wherein the seal keeps away dirt present at the drill pipe-side end of the inner drill pipe adapter and/or liquid present at the drill pipe-side end of the inner drill pipe adapter from the sliding contact arrangement.

10. The drill head according to claim 1, wherein a first end of a cable is electrically connected to at least a first contact element of the sliding contact arrangement, and wherein the cable is passed through a section of the first unit.

11. The drill head according to claim 10, wherein the first contact element and the first contact arrangement is electrically connectable to a cable passed through the inner drill pipe.

12. The drill head according to one of the preceding claims, characterized in that the first unit comprises one of a roller bit arrangement coupleable with the inner drill pipe and a down-the-hole hammer coupleable with the inner drill pipe.

13. The drill head according to claim 1, wherein a drilling fluid exiting at the drill head-side end of the double-drill pipe assembly from the assembly is conducted to the front end opposite to the drill pipe-side end of the drill head and exits the drill head thereat.

14. A device for drilling a bore in the ground, comprising a drill head according to claim 1, a double drill pipe assembly, and a drive unit, the drive unit driving the inner drill pipe and the outer drill pipe of the double drill pipe assembly at different speeds of rotation and/or in different directions of rotation.

* * * * *